US008382460B2

(12) United States Patent
Ramunas et al.

(10) Patent No.: US 8,382,460 B2
(45) Date of Patent: Feb. 26, 2013

(54) PERISTALTIC PUMP WITH CONSTRICTIONS AT FIXED LOCATIONS

(75) Inventors: John Ramunas, Stanford, CA (US); Juan G. Santiago, Stanford, CA (US); David P Fenning, San Juan Capistrano, CA (US); Viktor Shkolnikov, Chatsworth, CA (US)

(73) Assignee: The Board of Trustees of the Leland Stanford Junior University, Palo Alto, CA (US)

( * ) Notice: Subject to any disclaimer, the term of this patent is extended or adjusted under 35 U.S.C. 154(b) by 1030 days.

(21) Appl. No.: 12/290,650

(22) Filed: Oct. 31, 2008

(65) Prior Publication Data

US 2010/0111733 A1 May 6, 2010

(51) Int. Cl.
*F04B 43/08* (2006.01)

(52) U.S. Cl. ..... 417/474

(58) Field of Classification Search ..... 414/474–477.14
See application file for complete search history.

(56) References Cited

U.S. PATENT DOCUMENTS

| | | | | |
|---|---|---|---|---|
| 4,500,266 | A | 2/1985 | Cummins | |
| 5,622,482 | A | 4/1997 | Lee | |
| 6,024,545 | A | 2/2000 | Morioka | |
| 6,033,191 | A | 3/2000 | Kamper et al. | |
| 6,666,658 | B2 | 12/2003 | Takeuchi et al. | |
| 6,743,204 | B2 | 6/2004 | Christenson et al. | |
| 6,942,473 | B2 | 9/2005 | Abrahamson et al. | |
| 7,216,671 | B2 | 5/2007 | Unger et al. | |
| 7,226,278 | B2 | 6/2007 | Nason et al. | |
| 2002/0047099 | A1 * | 4/2002 | Grapes | 251/7 |
| 2010/0168672 | A1 * | 7/2010 | Carr | 604/153 |
| 2010/0174239 | A1 * | 7/2010 | Yodfat et al. | 604/153 |

* cited by examiner

*Primary Examiner* — Bumsuk Won
*Assistant Examiner* — Andrew Coughlin
(74) *Attorney, Agent, or Firm* — Lumen Patent Firm

(57) ABSTRACT

In a pump, a flexible tube passes through the pump and is held "normally closed" at an output constriction. The pump includes a pump body and a pump member that can perform two functions by their relative motion. The first function is to open and close an input constriction of the flexible tube. The second function is to compress the section of flexible tube between the input constriction and the output constriction. This section of tube acts as the pump chamber. When closed, the input constriction provides a greater impediment to fluid flow than the output constriction. Therefore, when the input constriction is closed and the pump chamber is compressed, fluid flows out of the pump past the output constriction. When the input constriction is open and compression of the pump chamber is removed, the output constriction closes and fluid can enter the pump by flowing past the location of the input constriction.

35 Claims, 10 Drawing Sheets

PERISTALTIC PUMP WITH CONSTRICTIONS AT FIXED LOCATIONS

FIELD OF THE INVENTION

This invention relates to pumps.

BACKGROUND

A peristaltic pump is a pump in which fluid is forced along by cycles of contraction produced mechanically on flexible tubing. One advantage of peristaltic pumps is that the pump mechanism is separated from the fluid being pumped within the flexible tubing, which can help reduce contamination of the fluid by the pump and can help reduce clogging or fouling issues. Various configurations of peristaltic pumps have been developed to date.

In one approach, e.g., as considered in U.S. Pat. No. 6,942,473, members mechanically engage with the tube to provide input valve action, output valve action, and pumping. In another approach, e.g., as considered in U.S. Pat. No. 6,743,204, a roller assembly in contact with the flexible tube creates a compression of the flexible tube that is moved along the tube to provide pumping action. In U.S. Pat. No. 6,024,545, a similar approach is considered, where a ring-shaped pressure member creates a moving compression point in the flexible tube to provide pumping action.

However, these conventional approaches can have some significant disadvantages. Approaches that rely on separate members for input valve action, output valve action, and pumping may require more complex mechanical designs to provide the appropriate operation sequence. For example, multiple actuators may be necessary. Approaches that rely on moving a point of compression along the flexible tube (e.g., rotary peristaltic pumps) can suffer from reduced mechanical efficiency and can lead more quickly to unwanted permanent deformation of the tubing.

Accordingly, it would be an advance in the art to provide improved pumping performance with pumps having a simpler mechanical configuration than conventional approaches, and to provide such pumps capable of being driven with a single actuator.

SUMMARY

Such a simplified pump is provided in an arrangement where a flexible tube passes through the pump and is held "normally closed" at an output constriction. The pump includes a pump body and a pump member that can perform two functions by their relative motion. The first function is to open and close an input constriction of the flexible tube. The second function is to compress the section of flexible tube between the input constriction and the output constriction. This section of tube acts as the pump chamber. When closed, the input constriction provides a greater impediment to fluid flow than the output constriction. Therefore, when the input constriction is closed and the pump chamber is compressed, fluid pressure overcomes the output constriction and fluid flows out of the pump past the output constriction. When the input constriction is open and compression of the pump chamber is removed, the output constriction automatically closes and fluid can enter the pump by flowing past the location of the input constriction.

Embodiments of the invention can provide several significant advantages singly and/or in combination. First, such pumps can provide substantially higher pressure than conventional miniature pumps, which is important for applications such as delivering drugs intravenously against blood pressure or forcing liquid flows into microchannels. Second, such pumps can require less operating voltage than conventional pumps, thereby simplifying associated circuitry. Third, pump fabrication and materials are relatively simple and robust, thereby reducing cost. Fourth, the pump can be made biocompatible by use of medical grade tubing, because no parts of the pump other than the tube interior touch the pumped fluid. Fifth, only a single actuator is required, thereby making the pump smaller, less expensive, more reliable and simpler to control than multi-actuator pumps. Finally, the pump requires no unidirectional check valves, which are a weak point of many existing miniature pumps because the valves can get jammed open by dirt or otherwise lose their seal, and because the valves tend to be difficult to manufacture on small scales.

DETAILED DESCRIPTION

Figure 1A:
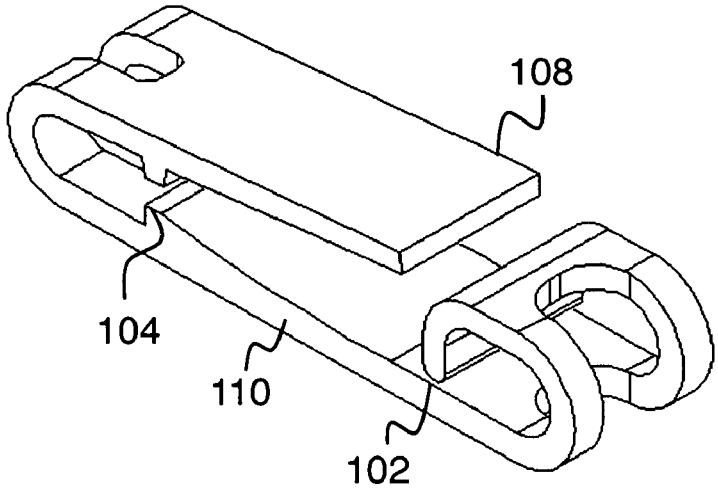
FIGS. 1*a-c* show several views of a first embodiment of the invention.
Figure 1B:
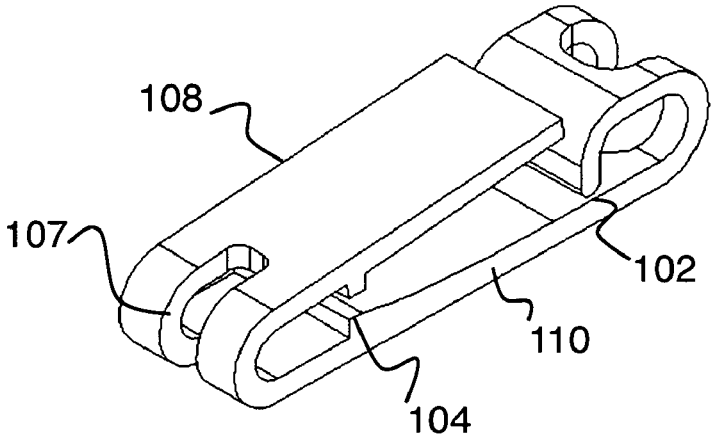
Figure 1C:
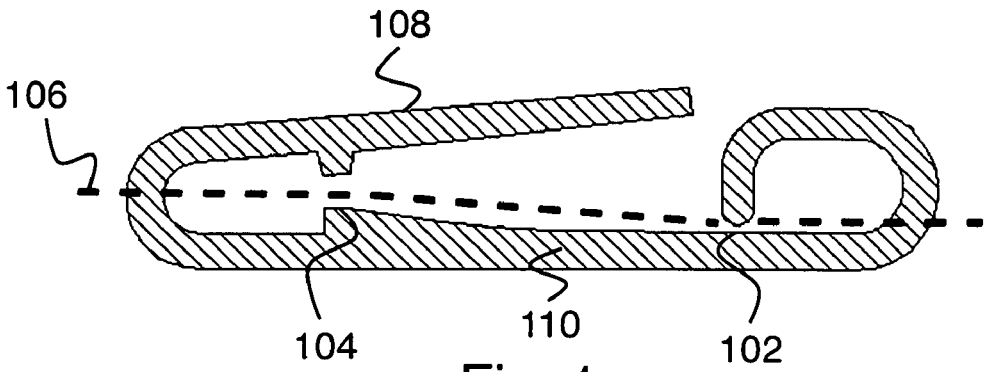

FIGS. 1*a-c* show several views of a first embodiment of the invention. The apparatus of FIGS. 1*a-c* includes a pump member 108 and a pump body 110, where pump member 108 is moveable relative to pump body 110. In this example, the axis of the flexible tube of the pump follows the path of dotted line 106 on FIG. 1*c*. The pump provides an output constriction 102 of the flexible tube. In this example, slot 107 provides horizontal compression of the flexible tube that is not so large as to block fluid flow through the tube. The purpose of this slot is explained below in connection with FIG. 3*b*, because it can better be appreciated after the following description of pump operation.

Figure 2:
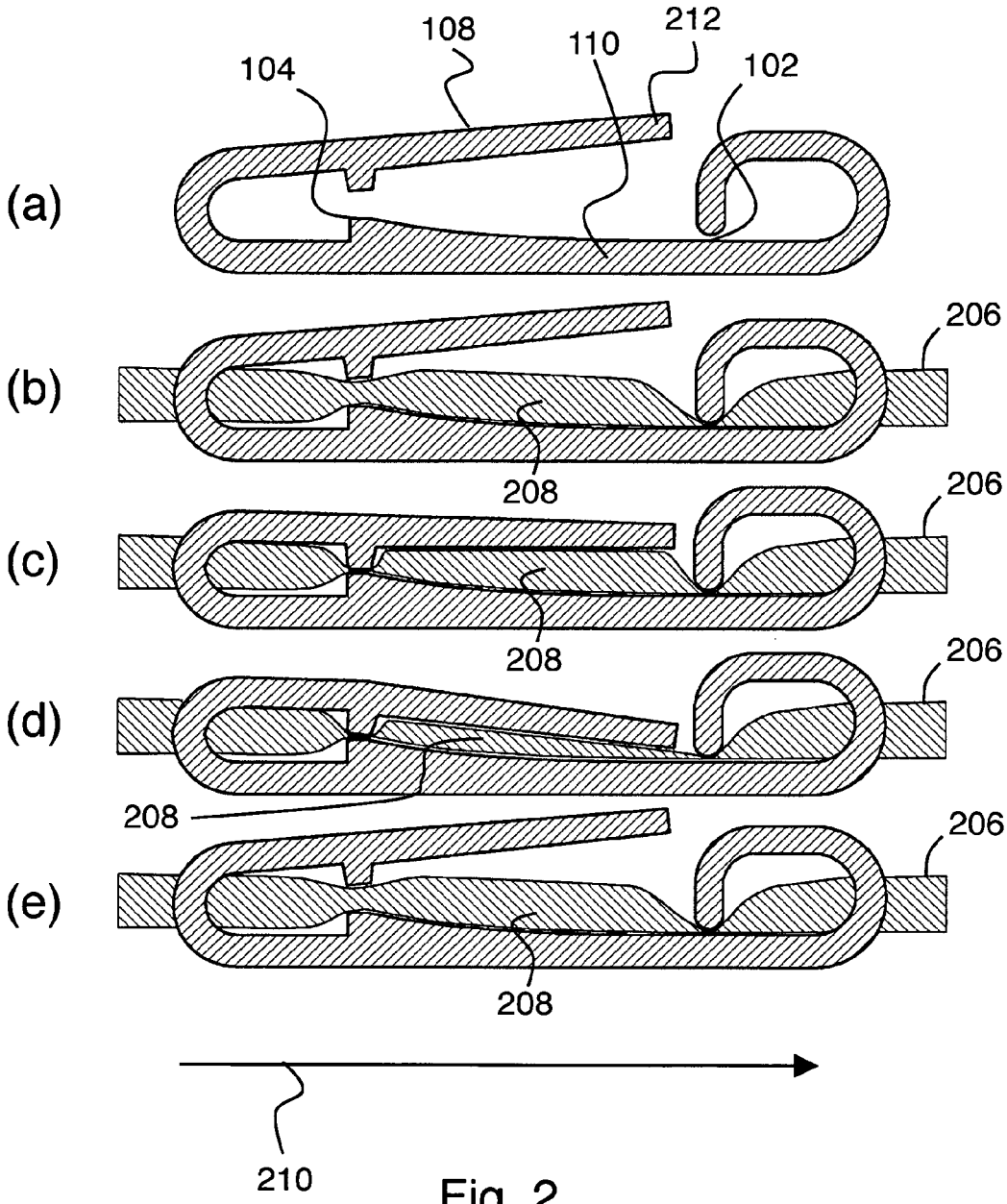
FIGS. 2*a-e* show several steps of the operating sequence of the pump of FIGS. 1*a-c*.

FIGS. 2*a-e* show an operation sequence for this example. FIG. 2*a* shows a side view of the part of FIGS. 1*a-c*. FIGS. 2*b* and 2*e* show the pump when pump member 108 is in its refill position. FIG. 2*c* shows the pump when pump member 108 is in its seal position. FIG. 2*d* shows the pump when pump member 108 is in its expel position. The flexible tube is shown as 206, and the direction of pumping is indicated with arrow 210.

A typical pump operation sequence entails moving the pump member from the refill position to the seal position, from the seal position to the expel position, and from the expel position to the refill position. This cycle can be repeated as needed to provide pumping. Important features of embodiments of the invention can be better appreciated by considering this sequence in greater detail.

When pump member 108 is in the refill position, as on FIG. 2*b*, fluid can flow into pump chamber 208 through input constriction 104 through tube 206 more easily than through output constriction 102. Preferably, output constriction 102 provides sufficient force on tube 206 to substantially prevent backflow (i.e., flow opposite to arrow 210) during pump operation, although it is not necessary for such backflow to be completely eliminated. Output constriction 102 is at a substantially fixed output location on flexible tube 206 during operation of the pump.

When pump member 108 is in the seal position, as on FIG. 2*c*, an input constriction of tube 206 is formed at input location 104. Input location 104 is at a substantially fixed position relative to flexible tube 206 during pump operation. Once formed, the input constriction impedes fluid flow through flexible tube 206 more than output constriction 102.

The part of flexible tube 206 between the input constriction at input location 104 and output constriction 102 defines a pump chamber 208 having a pump chamber volume. As pump member 108 moves from the seal position to the expel position, pump chamber 208 is compressed. Thus the pump chamber volume when pump member 108 is in the expel position is less than the pump chamber volume when pump member 108 is in the seal position, as shown.

FIG. 2*d* shows the pump state when pump member 108 is in the expel position. As indicated above, the input constriction at location 104 is more tightly closed than output constriction 102, so fluid that is expelled from pump chamber 208 in going from FIG. 2*c* to FIG. 2*d* is preferentially expelled past output constriction 102.

FIG. 2*e* shows the pump state when pump member 108 is again in the refill position. When the pump is in this state, the input constriction that can form at location 104 is partially or completely absent, thereby allowing pump chamber 208 to refill by fluid flow past input location 104.

There are several noteworthy features of this example. First, the required mechanical actuation is relatively simple. For example, a single actuator providing force near tip 212 of pump member 108 can be employed. Such a single actuator can be capable of driving the pump member to any of the refill, seal and expel positions. An actuator having a simple reciprocating motion can be employed, which is an advantage of this kind of pump compared to pumps which require more complicated actuation motions. Second, the pumping action and input valve action are both provided by the relative motion of the pump member with respect to the pump body. This tends to simplify the mechanical design of the pump. Third, the force applied by the pump to form the output constriction does not appreciably vary during operation of the pump. This feature also tends to simplify pump design, because the output constriction can be provided by a fixed pump feature. The opening and closing of the output constriction during pump operation is driven by pressure changes within the pump chamber, as opposed to external actuation.

Typically, practice of embodiments of the invention does not depend critically on the detailed composition or shape of flexible tube 206. However, some preferred embodiments of the invention can be enhanced by providing various optional features of this tube. In one preferred embodiment, flexible tube 206 is elastic (i.e., it tends to return to its original shape after being deformed, as a result of elastic forces). In another preferred embodiment, the outer surface of flexible tube 206 is coated with a material that limits diffusion of gas through the wall of the flexible tube during pump operation. This approach helps prevent bubble formation in a liquid being pumped (and can prevent escape of gas from the tube to the surroundings). If used, the coating is preferably present at least on the outer wall of pump chamber 208, and on tube 206 at input location 104. Suitable materials for limiting gas diffusion in this manner include grease and oil. Lubrication can be applied to the outer surface of flexible tube 206 at locations where the tube outer surface contacts the pump body or pump member, in order to reduce mechanical wear on the flexible tube. Tube 206 can be made of biocompatible elastomer, such as medical grade silicone.

In some cases, tube 206 may have further geometrical features. For example, tube 206 can have a smaller cross sectional area at the input constriction than in pump chamber 208, which may be helpful in getting sufficiently complete flow blockage at the input constriction. As another example, tube 206 can be enlarged on the opposite side of the input constriction location from pump chamber 208 (e.g., to the left of location 104 on FIGS. 2*a-e*) in order to provide an input reservoir. Tube 206 can have a circular or non-circular cross section. In all cases, at least one wall section of the tube wall is flexible.

Although it is not required, it is often preferred to employ one or more elastic mechanisms that provide elastic restoring forces to expedite pump operation. For example, an elastic mechanism can be employed that tends to hold pump chamber 208 open. Similarly, a nominal relative position of pump member 108 and pump body 110 can be provided by an elastic mechanism. Preferably, such a nominal relative position is either the refill position or the expel position. In the example of FIGS. 2*a-e*, the nominal relative position is the refill position of FIGS. 2*b* and 2*e*, and movement between the seal position (FIG. 2*c*) and the expel position (FIG. 2*d*) entails elastic deformation of pump member 108 and of the joint between pump member 108 and pump body 110. By making use of elastic restoring forces in this manner, pump actuation can be simplified and pump actuation rate can be increased. Pump motion from the expel state of FIG. 2*d* to the refill state of FIG. 2*e* can be driven by the elastic restoring forces, so actuation at tip 212 need only include a capability of providing a downward force on FIGS. 2*a-e*. In other words, "push only" actuation is sufficient in this example, and "push and pull" actuation is not required.

Practice of these embodiments of the invention does not depend on details of how this elastic mechanism is provided, and any such mechanism is applicable. For example, suitable elastic mechanism approaches include but are not limited to: an elastic joint connecting the pump member and the pump body; a compression spring, torsion spring, or leaf spring in contact with the pump member and the pump body; visco-elastic properties of the flexible tube; visco-elastic properties of a material in the lumen of the flexible tube; and elastic properties of the pump member and/or the pump body.

As an example of the use of elastic restoring forces, it is preferred for the expansion of pump chamber 208 as the pump cycle moves from expel position (FIG. 2*d*) to refill position (FIG. 2*e*) to be driven by elastic restoring forces. Such restoring forces can be provided by the walls of flexible tube 206, if tube 206 is also elastic. Alternatively, tube 206 can be attached to pump member 108 and pump body 110 so that when the pump member is at its refill position, force is exerted on flexible tube 206 tending to cause its lumen to open.

Practice of the invention does not depend critically on the composition of pump member 108 and pump body 110. Any material having suitable mechanical and elastic properties can be employed. For example, high density polyethylene, acetal, acrylonitrile butadiene styrene (ABS), polypropylene, polyvinylchloride (PVC), or stainless steel can be employed.

To avoid inefficiency in pumping, it is preferred for the volume of pump chamber 208 to be substantially the same when the pump member is at the refill and seal positions (e.g., as shown on FIGS. 2*a-e*). For precision in this context, it is helpful to regard the "seal position" as being that point in the pump cycle where the input constriction first provides a greater impediment to fluid flow than the output constriction. Accordingly, if the pump chamber volume changes during the pump cycle as preferred above, then most or all of the fluid expelled from pump chamber 208 will flow past the output constriction, as desired for efficient pumping. Little or no fluid will be expelled backward past the input constriction.

In some embodiments, it is preferable for the effectiveness of output constriction 102 in blocking flow of material in tube 206 to be mechanically adjustable. Providing this adjustment capability allows adjustment of the maximum back pressure the pump can withstand at its output before material starts to flow backward through the pump, and allows adjustment of the minimum pump chamber pressure required to cause flow past output constriction 102. Methods for providing such adjustment capability are well known in the art (e.g., a set screw to adjust the compression of the tube at the output constriction), and any such method is suitable for use with embodiments of the invention.

Practice of embodiments of the invention does not depend critically on details of how pump actuation is provided. Suitable actuation approaches include, but are not limited to: piezoelectric actuators, solenoids, electro-osmotic pumping, shape memory alloy wire, motor-driven cams, and manual actuation.

For simplicity, the medium being pumped is often referred to as a fluid in this description. However, embodiments of the invention are applicable for pumping any and all deformable materials that can be pumped, including materials that may not be regarded as being fluids. Such deformable materials include but are not limited to: liquids, gases, complex fluids, foams, slurries, gels, colloidal suspensions, mixtures of immiscible liquids, mixtures of liquids and gases, powders, and granular materials.

Typically, embodiments of the invention include one or more mechanisms for restricting the ranges of movement of the pump body and of the pump member so that they move to said refill, seal, and expel positions when acted upon by an actuator. Such mechanisms include but are not limited to: a coupling of the pump member and pump body to each other by hinges or by making them contiguous parts of the same piece of flexible material; anchoring of the pump member and pump body to a support; and shaping parts of the pump member and pump body so that they have surfaces that push against each other.

In some embodiments, it is preferred for the volume of pump chamber 208 to be adjustable. For example, such adjustment can be provided with a set screw to alter the relative position of the pump member and pump body at the refill, seal, and/or expel positions.

Practice of the invention does not depend critically on the size of the pump, and microscopic (with say 100 micron features), mesoscopic (with say 1 mm features), and macroscopic (with centimeter or larger features) embodiments are possible. For mesoscopic and macroscopic pumps, the pump body and member can be made by standard manufacturing techniques, such as injection molding, host casting, laser cutting, or laser ablation. For microscopic pumps, the tube can be made by heating and pulling a macroscopic tube to microscopic dimensions, and the pump body and member can be made with standard micro-fabrication techniques. The pump is highly scalable in physical dimensions (micrometers to centimeters), pulse volume (nanoliters to milliliters), and average flow rate (zero to milliliters per second).

Figure 3A:
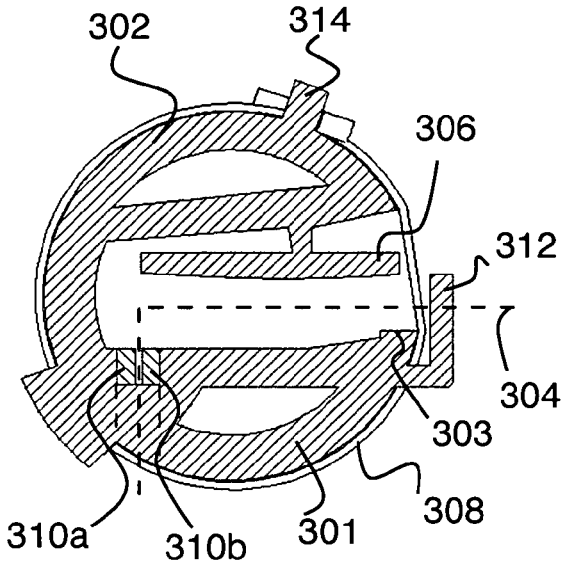
FIGS. 3*a-c* show several views of a second embodiment of the invention.
Figure 3B:
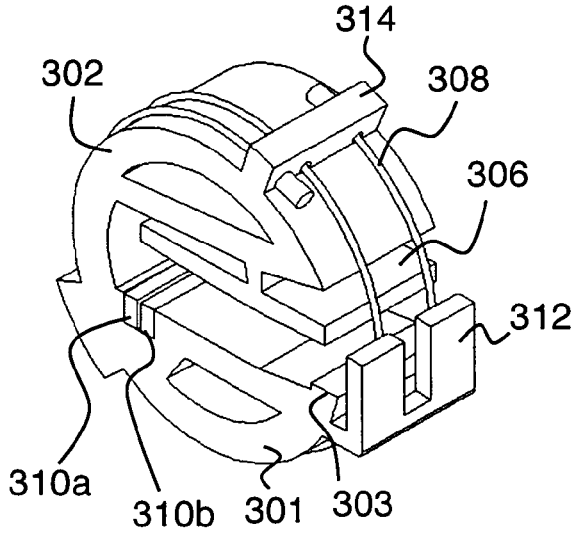
Figure 3C:
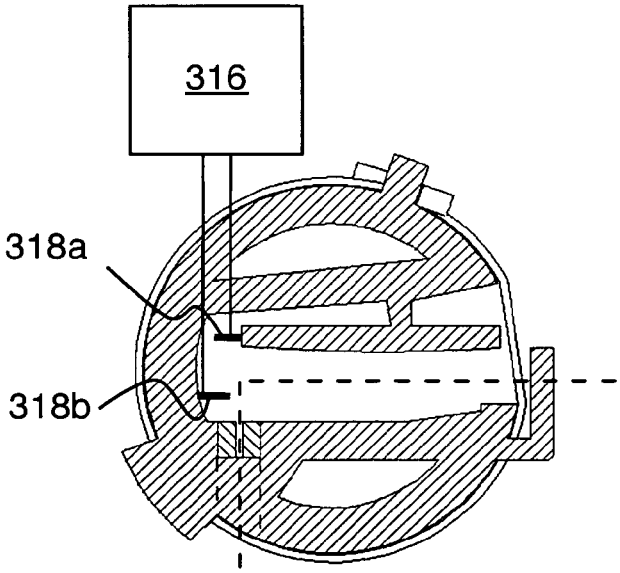

FIGS. 3*a-c* show several views of a second embodiment of the invention. In this example, the path of the axis of the flexible tube is shown by dotted line 304. The pump member of this embodiment includes a major lever 302 and a minor lever 306 that is mechanically coupled to major lever 302. Operation of this kind of dual-lever arrangement is described below in connection with FIGS. 4*a-h*. The example of FIGS. 3*a-c* also includes several other features of preferred embodiments of the invention.

In the example of FIGS. 3*a-c*, the output constriction in the flexible tube is formed by pads 310*a* and 310*b*. As shown by tube path 304, the flexible tube bends near the output constriction. In some embodiments, it is preferred for the tube to be bent at this location such that a kink forms in the tube. Such a kink can be helpful in forming the output constriction.

Pump actuation is provided in this example by a shape memory alloy (SMA) wire 308 that is wrapped one or more times around the pump, and is mechanically anchored at anchor/guide point 314. Such a wire can change its length in response to an input. For example, passing a current through the wire can cause resistive heating, and the resulting temperature increase can cause contraction of the wire, and of the pump. Expansion of the pump, driven by elastic restoring forces between pump body 301 and major lever 302, can occur when the electrical current in wire 308 is removed. In these embodiments, it is preferred for the pump to have a perimeter with a convex outer curve (e.g., a roughly circular perimeter as shown), so that forces between SMA wire 308 and the rest of the pump are more evenly distributed. The pump perimeter can be lubricated where it touches the SMA wire. Guides for the SMA wire can be included to ensure that the wire actuator does not slip off the rest of the pump. Preferably, the nominal tension of SMA wire 308 is mechanically adjustable. Means of adjusting the tension of SMA wire 308 include adjusting a set screw that changes the effective length of the perimeter of the pump. Practice of these embodiments of the invention does not depend critically on how electrical power is provided to SMA wire 308, and so any source of electrical power is suitable.

Tube path 304 passes through slotted member 312. Slotted member 312 is near the input constriction location 303. The purpose of the slot in slotted member 312 is to partially compress the flexible tube without blocking flow of fluid in the tube, such that the tube compression provided by this slot causes the lumen of the tube to tend to open at input constriction 303 when the pump member is at the refill position. In this example, the input constriction at location 303 is formed by vertical compression of the tube, while the slot in member 312 provides horizontal compression of the tube. The horizontal compression provided by the slot in member 312 tends to cause the lumen of the flexible tube to open at input location 303 when the pump is at its refill position.

In some embodiments, sensors (e.g., electrical contacts 318*a* and 318*b*) provide feedback on the position of the pump member relative to the pump body to a control circuit 316, as shown on FIG. 3*c*. In this embodiment, contact between electrical contacts 318*a* and 318*b* provides an electrical signal that indicates that pump member 306 is at a specific position relative to pump body 301. Such arrangements can further include a driving circuit that causes the pump member to move to the seal, expel and refill positions in succession, in response to one or more pulses that initiate pump member motion from the refill position. Such pulse-driven control can provide a useful degree of flexibility in controlling pump operation. For example, feedback control can be employed to cause the pump to deliver less than the full volume of the pump chamber in a single pumping cycle.

FIGS. 4*a-h* show several steps of the operating sequence of dual-lever embodiments of the invention. Such dual-lever embodiments have been found to provide significant performance advantages in practice. In this example, the output constriction of flexible tube 412 is at 404, the input constriction location is 402, the pump body is 414, the pump member includes major lever 408 and minor lever 410, and pump actuation is vertically as shown by arrow 406.

Figure 4:
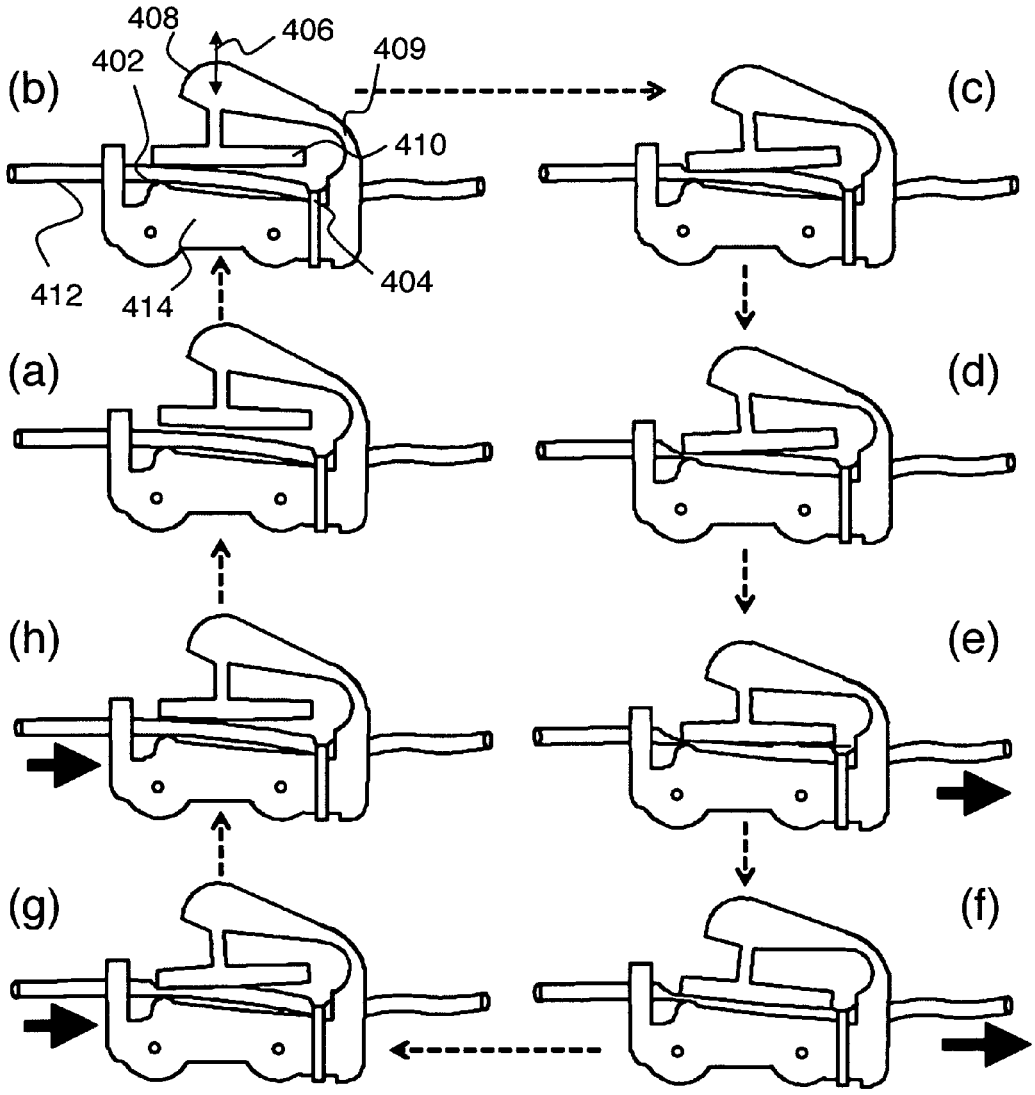
FIGS. 4*a-h* show several steps of the operating sequence of dual-lever embodiments of the invention.

The cycle can be taken to start at the refill position shown in FIG. 4*a*. As the pump moves from the refill position of FIG. 4*a* to the seal position of FIG. 4*d*, most of the pump motion is a rotation of major lever 408 about joint 409, and the main effect on tube 412 of this part of the cycle is to form the input constriction at location 402.

As the pump moves from the seal position of FIG. 4*d* to the expel position of FIG. 4*f*, major lever 408 continues to rotate about joint 409. In addition, minor lever 410 rotates about a support created at the input constriction by contact between minor lever 410 and tube 412. The main effect on tube 412 of this part of the cycle is to compress the pumping chamber formed between the input constriction and the output constriction, thereby driving fluid flow out of the pump through the output constriction at 404 as shown by the large arrows on FIGS. 4*e-f*.

As the pump moves from the expel position of FIG. 4*f* to the refill position of FIG. 4*a*, the input constriction at 402 and the pump chamber open, thereby allowing fluid flow into the pump as shown by the large arrows on FIGS. 4*g-h*.

Dual-lever designs as described above are helpful for pump design because substantial independence can thereby be introduced into the pump motions that close the input constriction and that compress the pump chamber. In particular, ensuring that the input constriction closes before the pump chamber is significantly compressed can be simplified with this approach. In the above example, input constriction location 402 is far away from rotation point 409, so closing of the input constriction desirably tends to occur early in the pump cycle.

Typically it is preferred for the major and minor levers to tend to return to a nominal position relative to each other due to an elastic mechanism. Practice of the invention does not depend on the details of this elastic mechanism, as described above. Frequently, as in the example of FIGS. 4*a-h*, the major and minor levers are contiguous parts of the pump member. In some cases, it is preferred to limit the range of motion of the minor lever relative to the major lever by allowing the minor lever to contact the major lever during part of the pumping cycle. The method of mechanically coupling the major lever to the minor lever is also not critical. Suitable mechanisms include, but are not limited to: hinges, bearings, springs, sliding contact between surfaces of the major and minor levers, and fabrication of the major and minor levers as parts of a contiguous member.

Several prototypes have been fabricated according to embodiments of the invention, with promising results. Three different pump versions were tested. Pump version A was optimized for size, weight and pressure, pump version B was optimized for energy efficiency and flow rate, and pump version C was optimized for pressure. For comparison purposes, all three pump configurations employed the same flexible tubing (VWR Select Silicone, 0.058" ID×0.076" OD×0.009" wall). The results are shown in Table 1, which follows.

TABLE 1

Pump performance for several pump designs

| | A | B | C |
|---|---|---|---|
| Size (mm) | 15 × 14 × 5 | 35 × 20 × 9 | 24 (diameter) × 5 |
| Weight (g) (without tubing) | 0.75 | 3.4 | 1.6 |
| Max. flow rate (μl/min) | 60 | 130 | 48 |
| Max pressure (psi) | 10+ | 5+ | 10+ |
| Volume/pulse (μl) | 4.0 | 4.2 | 4.8 |
| Max pulses/min | 15 | 30 | 10 |
| Power at max flow rate (mW) | 420 | 140 | 450 |
| Energy/μl (J) | 0.43 | 0.065 | 0.56 |
| Energy/pulse (J) | 1.7 | 0.27 | 2.7 |

Figure 5A:
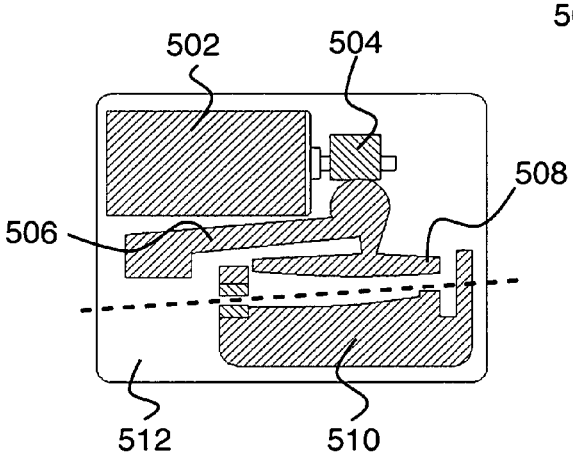
FIGS. 5*a-b* show two views of a third embodiment of the invention.
Figure 5B:
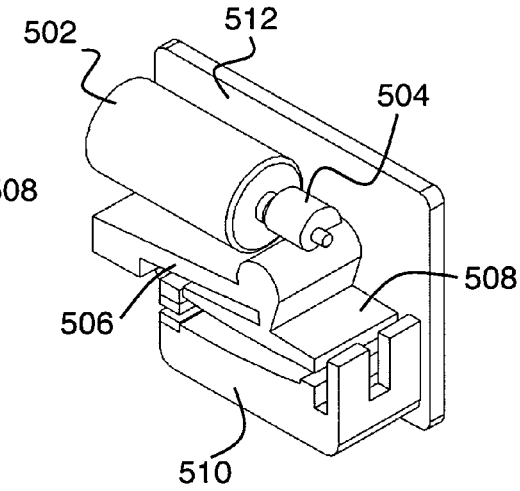

FIGS. 5*a-b* show two views of a third embodiment of the invention. In this embodiment, a motor 502 having a cam 504 on its shaft provides pump actuation. Cam 504 is in contact with major lever 506 of the pump member. The pump member also includes minor lever 508. Pump body 510, as well as motor 502 and one end of the pump member, are affixed to a plate 512. Operation of this embodiment is as described above in connection with FIGS. 4*a-h*. Preferably, friction between cam 504 and the pump member is reduced, e.g., by lubrication and/or by use of a bearing.

Figure 6A:
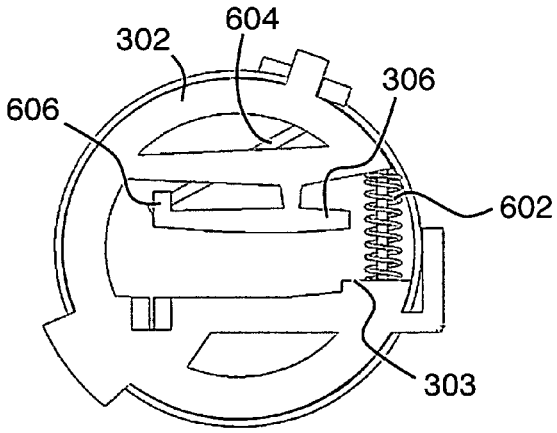
FIGS. 6*a-b* show two views of a fourth embodiment of the invention.
Figure 6B:
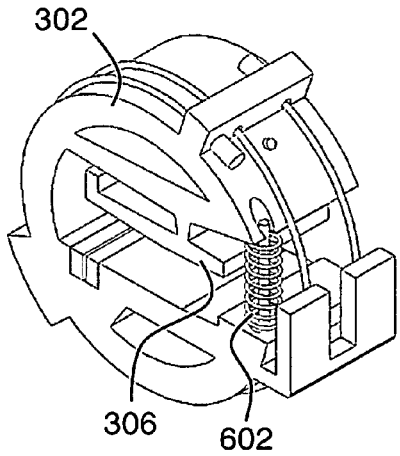

FIGS. 6*a-b* show two views of a fourth embodiment of the invention. This embodiment is similar to the embodiment of FIGS. 3*a-b*, except for two differences. The first difference is that a spring 602 is added to provide a restoring force for the pump. The second difference is that an elastic member 604 connects end 606 of minor lever 306 to major lever 302. Elastic member 604 is in tension, which helps close the input constriction at input location 303 earlier in the pump cycle, which is desirable as explained above. In situations where elastic member 604 is employed, it is preferred to arrange the geometry such that the length of elastic member 604 changes relatively little during a pump cycle (e.g., as shown). This approach advantageously reduces the amount of force required to stretch elastic member 604 during the pumping cycle, allowing use of weaker actuators and improving the energy efficiency of the pump. This approach can also advantageously reduce unwanted long term wear of member 604. Long term wear includes but is not limited to permanent deformations of 604 including creep and fatigue of the material.

Figure 7A:
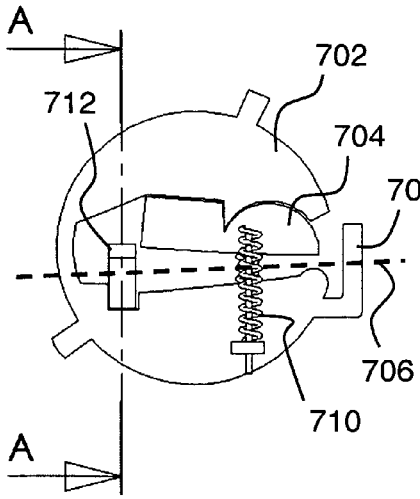
FIGS. 7*a-c* show several views of a fifth embodiment of the invention.
Figure 7B:
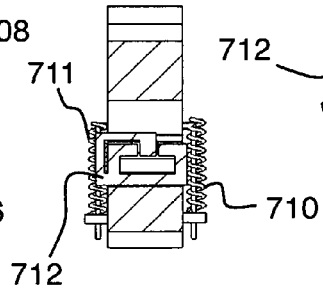
Figure 7C:
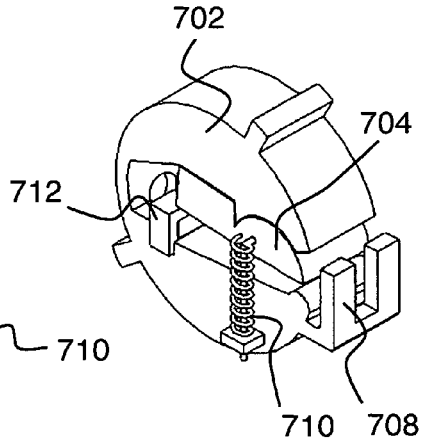

FIGS. 7*a-c* show several views of a fifth embodiment of the invention. FIG. 7*b* shows a cross section view along line AA of FIG. 7*a*. This embodiment is similar to the embodiment of FIGS. 6*a-b*, except for three differences. The first difference is that minor lever 704 is in slidable contact with major lever 702. More specifically, minor lever 704 has a curved surface that fits a complementary curved surface of major lever 702.

Rotation of minor lever 704 occurs by movement of the complementary surfaces relative to each other. The advantage of this is that this type of connection between the major and minor levers is less subject to fatigue than the contiguous connection between the two levers in the embodiment in FIGS. 6*a-b*, and the amount of force required to move the minor lever relative to the major lever is typically smaller. The second difference is that springs 710 and 711 provide a restoring force for the pump. The advantage of this is that springs 710 and 711 provide elasticity which can substitute for (or enhance) the elasticity provided by elastic member 604, spring 602, and the elastic joint between pump member 302 and the pump body in the embodiment of FIGS. 6*a-b*, and spring 1214 in the embodiment of FIGS. 12*a-b* and 12*d*, described below. This can simplify the pump design and improve energy efficiency and durability. The third difference is that the output constriction is provided by a clip 712. Further details of such output constriction clips are given in connection with FIGS. 9*a*-11*b*. Here the flexible tube follows a straight path 706 through the pump. A slotted member 708 provides the same function as member 312 on FIGS. 3*a-b*.

Figure 8A:
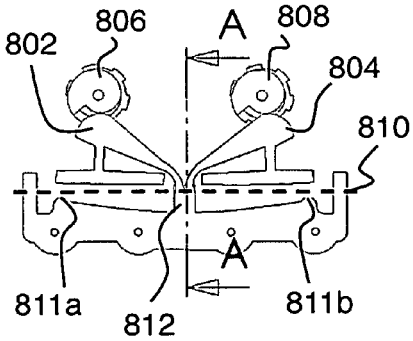
FIGS. 8*a-c* show several views of a sixth embodiment of the invention.
Figure 8B:
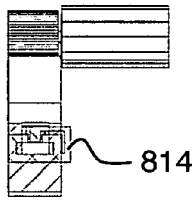
Figure 8C:
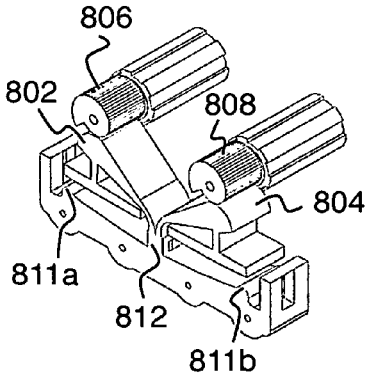

FIGS. 8*a-c* show several views of a sixth embodiment of the invention. FIG. 8*b* shows a cross section view along line AA of FIG. 8*a*. This is an example of a bi-directional pump. The tube path is shown by dotted line 810. In cases where left-to-right pumping is needed: cam 806 drives dual-lever pump member 802; the input constriction forms at location 811*a*; clip 814 at output constriction location 812 provides the output constriction; and cam 808 is set to a fixed position so that pump member 804 does not affect fluid flow. In cases where right-to-left pumping is needed: cam 808 drives dual-lever pump member 804; the input constriction forms at location 811*b*; clip 814 at output constriction location 812 provides the output constriction; and cam 806 is set to a fixed position so that pump member 802 does not affect fluid flow. In this manner, the output constriction of two back to back pumps can be shared, which can advantageously decrease pump size and reduce cost, and avoids having a dead volume in the tube between two different output constrictions.

Some of the preceding examples have included clips for forming the output constriction. FIGS. 9*a*-11*b* show some examples of output clips suitable for use with embodiments of the invention.

Figure 9A:
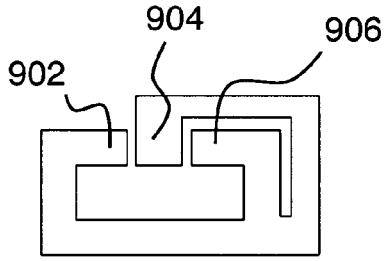
FIGS. 9*a-b* show two views of a first output clip suitable for use with embodiments of the invention.
Figure 9B:
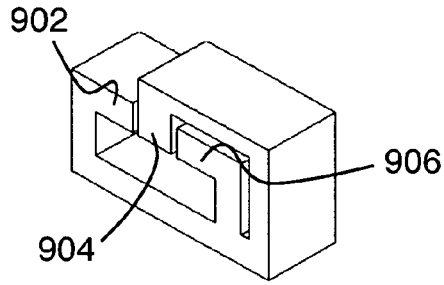

FIGS. 9*a-b* show two views of a first output clip suitable for use with embodiments of the invention. Once this clip is fitted around an elastic tube, the edges of the elastic tube are compressed beneath sections 902 and 906 of this clip, while the center portion of the tube is compressed by section 904 of the clip. The main point of this kind of clip arrangement is to provide less force on the central part of the tube than on the tube edges because the tube edges typically require more force to compress than the tube center due to the presence of the tube walls at the edges. Applying less force on the center of the tube has the advantage of allowing for the initiation of flow through the output constriction at lower pump chamber pressures, and lowering pressure drop through the output constriction while the pump is expelling fluid. In this example, section 904 would apply less force to the tube than sections 902 and 906 of the clip.

During pump operation, only the part of the tube under section 904 of the clip opens up as fluid is forced past the output constriction. The edges of the flexible tube remain closed at the output constriction for all parts of the pumping cycle. In this manner, the pump chamber pressure required to overcome the output constriction can advantageously be reduced compared to a similar pump having the same output constriction force applied to the edges and the center of the tube.

Figure 10A:
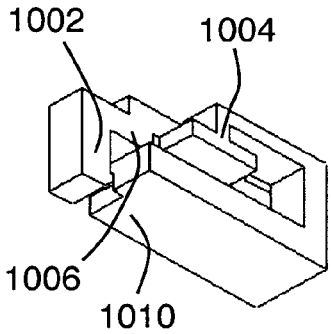
FIGS. 10*a-c* show several views of a second output clip suitable for use with embodiments of the invention.
Figure 10B:
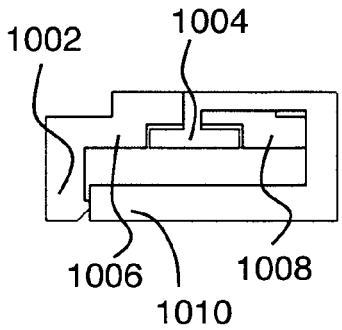
Figure 10C:
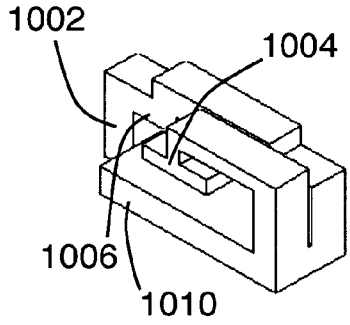

FIGS. 10*a-c* show several views of a second output clip suitable for use with embodiments of the invention. This clip does not need to be threaded along the flexible tube (from the tube end). Instead, a mechanical catch formed by members 1002 and 1010 can be opened, the tube can be inserted, and then the clip can be closed around the tube. Once this is done, edge sections 1006 and 1008 compress the edges of the flexible tube, while section 1004 compresses the center of the flexible tube with reduced force. In this manner, this type of clip can simplify the assembly of the clip into the pump structure.

Figure 11A:
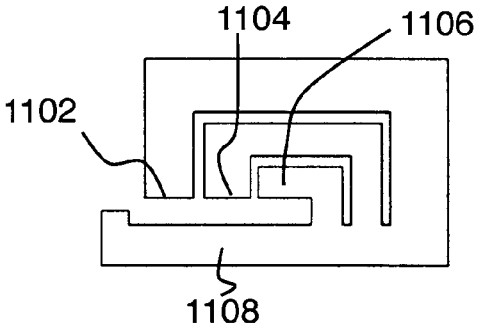
FIGS. 11*a-b* show two views of a third output clip suitable for use with embodiments of the invention.
Figure 11B:
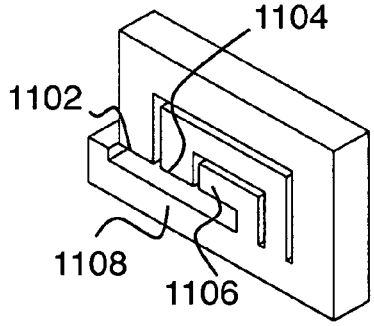

FIGS. 11*a-b* show two views of a third output clip suitable for use with embodiments of the invention. This clip can be installed by sliding the flexible tube into the slot between sections 1102-6 and base 1108. Once this is done, edge sections 1102 and 1106 compress the edges of the flexible tube, while section 1104 compresses the center of the flexible tube with reduced force.

FIGS. 12*a-d* show several views of a seventh embodiment of the invention. Here cam 1208 drives a pump member including major lever 1210 and minor lever 1212. This embodiment is similar to earlier double-lever embodiments of the invention, except for three differences. The first difference is that an input clip 1206 is disposed near input constriction location 1202. The second difference is that a spring 1214 is disposed between major lever 1210 and minor lever 1212 to help ensure the input constriction closes early in the pump cycle. The third difference relates to details of the output constriction.

Figure 12A:
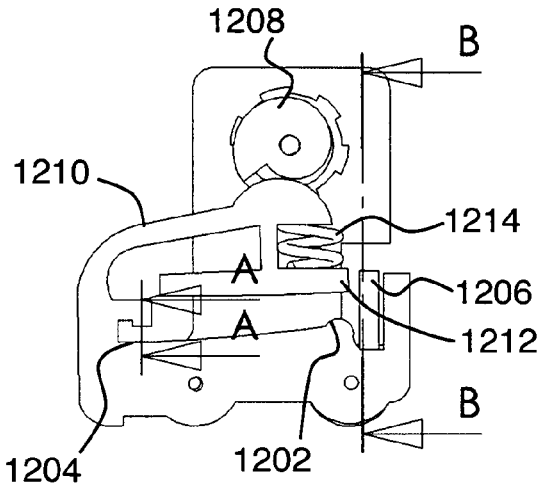
FIGS. 12*a-d* show several views of a seventh embodiment of the invention.
Figure 12B:
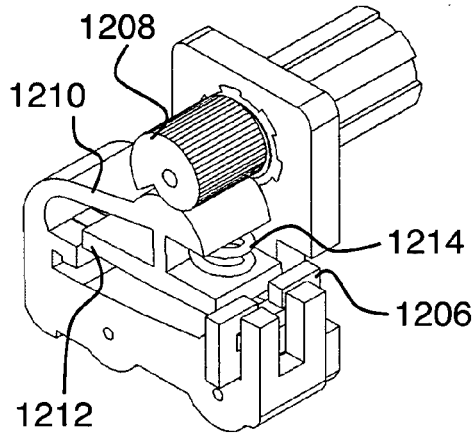
Figure 12C:
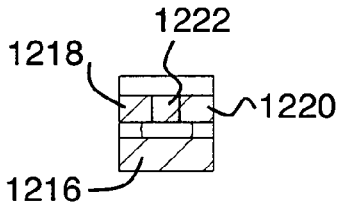

FIG. 12*c* shows a cross section view along line AA of FIG. 12*a*. As shown, the cross-hatched sections indicate the material of the main pump body near 1204. Here the pump body locally has features similar to the output clip of FIGS. 9*a-b*. Members 1218 and 1220, in combination with base 1216, provide relatively strong compression of the edges of the flexible tube, while member 1222 provides weaker compression near the center of the tube. Member 1222 deforms and allows flow past the output constriction during the expel cycle.

Figure 12D:
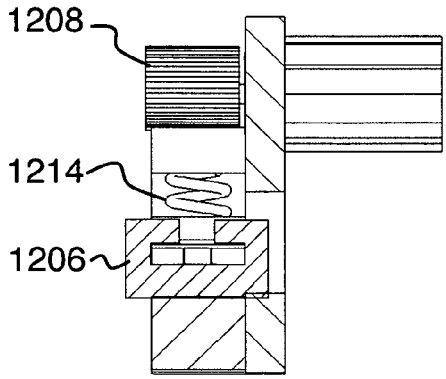

FIG. 12*d* shows a cross section view along line BB of FIG. 12*a*. In this view, input clip 1206 can be more clearly seen. Input clips such as 1206 on FIGS. 12*a-d* are similar to the above-described output clips, in that the main purpose is to keep the tube edges under constant (and relatively high) compression. By "pre-compressing" the tube edges with an input clip in this manner, the amount of force required from the pump member to fully close the input constriction can also be advantageously decreased. Preferably, the tube walls at the edges are at least partially collapsed by the input clip.

Figure 13A:
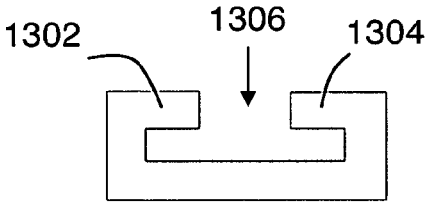
FIGS. 13*a-b* show two views of an input clip suitable for use with embodiments of the invention.
Figure 13B:
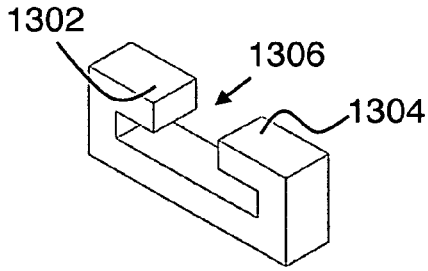

FIGS. 13*a-b* show two views of an input clip suitable for use with embodiments of the invention. The main difference between input clips and output clips is that input clips are "open" at the center. For example, the clip of FIGS. 13*a-b* compresses the tube edges with sections 1302 and 1304, but is open at 1306. Input clips need to be open at the center because the flexible tube is not "normally closed" at the location of the input constriction, and motion of the pump member (e.g., near contact point 1212) opens and closes the input constriction. In contrast, output clips provide a fixed output constriction force.

A clip is one method of providing this input pre-compression capability. Any other mechanism that can perform the function of pre-compressing the tube edges can also be employed as an input constriction adapter. The above-described input clips are one example of such input constriction adapters.

Input and/or output clips can also serve other functions. For example, an input or output clip that is affixed to the flexible tube and which engages with the pump body can perform the function of preventing motion of the tube relative to the pump body. Alternatively, relative motion of tube and pump body can also be prevented with any other mechanism for preventing such motion. For example, input slots such at 107 on FIGS. 1*b* and 312 on FIG. 3*b* can also provide this capability.

Figure 14A:
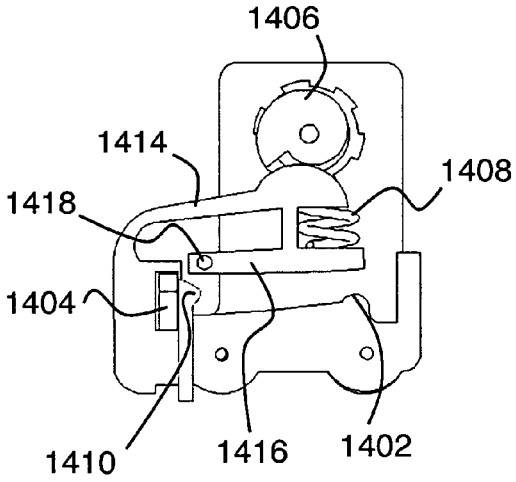
FIGS. 14*a-b* show two views of an eighth embodiment of the invention.
Figure 14B:
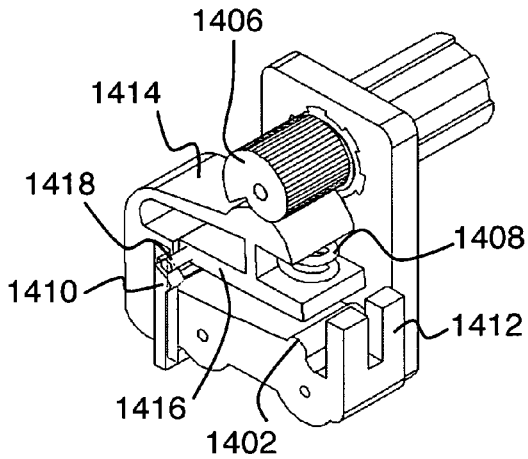

FIGS. 14*a-b* show two views of an eighth embodiment of the invention. In this embodiment, the pump member includes major lever 1414 and minor lever 1416, and is actuated by cam 1406. A spring 1408 is disposed between major lever 1414 and minor lever 1416 to help close the input constriction at input location 1402 early in the pump cycle. Slotted member 1412 provides horizontal compression of the flexible tube as described above in connection with FIGS. 3*a-c*. An output clip 1404 is used to provide the output constriction of the flexible tube.

In this example, an elastic member 1410 is present that can make contact with the pump member during pump operation. Here, this contact is made by way of a member 1418 on minor lever 1416. The importance of these pump features can be better appreciated by considering the pump sequence as described above in connection with FIGS. 4*a-h*. This sequence can be summarized as: (A) input constriction closes, (B) pump chamber compresses, (C) pump chamber expands, and (D) input constriction opens. Thus, the normal sequence is A-B-C-D.

However, if the pump chamber expands rapidly when the input constriction is closed, as in the normal pumping sequence, bubbles can form in the fluid being pumped as a result of low pressure in the pump chamber. Low pressures can lead to outgassing of the liquid (gas driven out of solution), an increase in intake of diffusion through permeable tube walls, and/or cavitation of a working liquid. In cases, where such bubble formation is to be avoided, a pump sequence closer to A-B-D-C than to A-B-C-D may be preferred. The example of FIGS. 14*a-b* provides this functionality as follows. When the pump chamber is being compressed, member 1418 will engage with elastic member 1410, and will eventually snap past this member as the pump reaches the expel position. As the pump moves from the expel position to the refill position, upward motion of minor lever 1416 near the output constriction (i.e., near output clip 1414) will be hindered by engagement of member 1418 with member 1410. This hindrance will tend to cause the input constriction at 1402 to open up earlier in the pump cycle than it would if that hindrance were not present, and will tend to cause the pump chamber to expand in volume later in the pump cycle than it would if that hindrance were not present, thereby alleviating the above-described bubble formation problem. Eventually, member 1418 will snap past elastic member 1410 as the pump moves to its refill position.

The specific arrangement of FIGS. 14*a-b* is one example of a mechanism suitable for altering the pump sequence as described. Any other mechanism capable of performing this function is also suitable for use in embodiments of the invention.

Figure 15A:
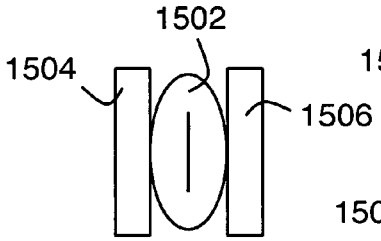
FIGS. 15*a-h* show several examples of output constriction arrangements suitable for practicing embodiments of the invention.
Figure 15B:
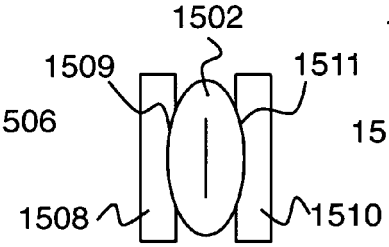

In some of the previous examples, output clips are employed to form the output constriction. Mechanisms other than clips can also be employed to form the output constriction. FIGS. 15*a-e* show several examples of output constriction arrangements suitable for practicing embodiments of the invention. FIG. 15*a* shows a flexible tube 1502 compressed between rigid or semi-rigid members 1504 and 1506 on opposite sides of the tube. The example of FIG. 15*b* is similar to the example of FIG. 15*a*, except that rigid or semi-rigid members 1508 and 1510 have curved depressions 1509 and 1511, respectively, into which flexible tube 1502 fits. This arrangement provide more constriction force at the tube edges than the tube center, which is desirable as explained above.

Figure 15C:
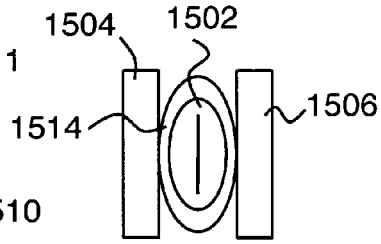
Figure 15D:
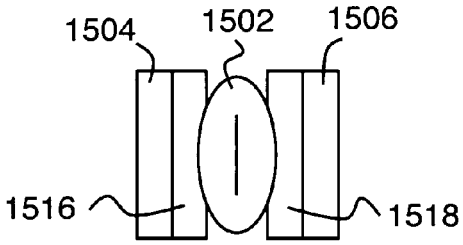
Figure 15E:
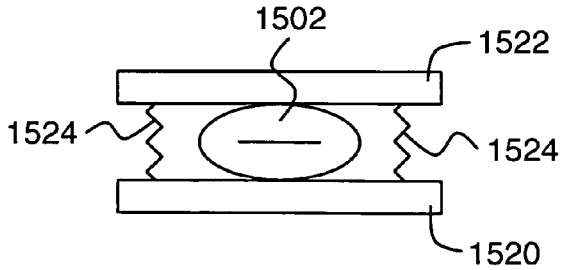
Figure 15F:
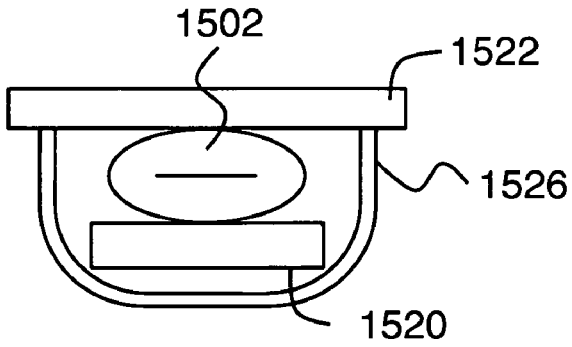
Figure 15G:
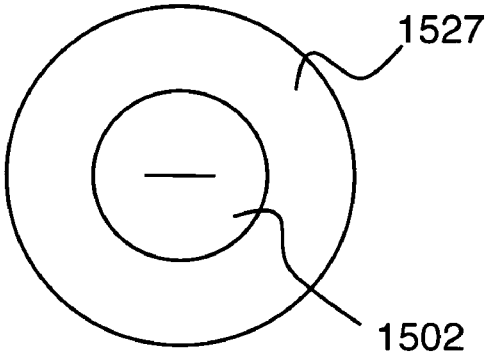
Figure 15H:
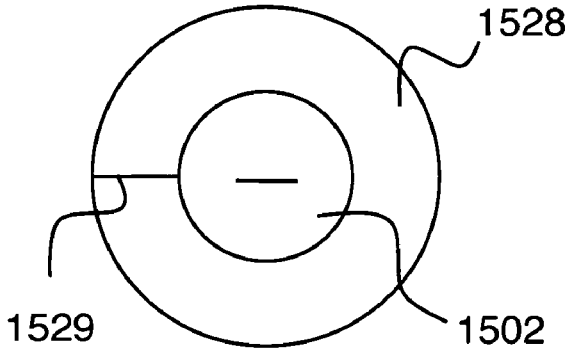

In the example of FIG. 15*c*, an elastomeric tube 1514 is disposed around flexible tube 1502. In the example of FIG. 15*d*, elastomeric substances 1516 and 1518 are disposed between tube 1502 and rigid or semi-rigid members 1504 and 1506. In the example of FIG. 15*e*, tube 1502 is compressed between a rigid or semi-rigid member 1520 and a rod 1522 that is elastically anchored to member 1520 by springs 1524. In the example of FIG. 15*f*, tube 1502 is compressed between a rigid or semi-rigid member 1520 and a rod 1522 that is elastically pulled towards member 1520 by elastomer 1526. In the example of FIG. 15*g*, elastic tube 1502 passes through elastic member 1527 which surrounds and compresses said tube. The hole in elastic member 1527 (through which tube 1502 passes) can have a circular, elliptical, rectangular, or other shape. The cross-section of elastic member 1527 can be circular, rectangular, or have another shape, or have different shapes at different locations. In one example of the type of output valve in FIG. 15*g*, elastic member 1527 is a toroidal O-ring made of Buna-N with inner and outer diameters of 0.029 and 0.109 inches, respectively, and a circular cross-section with a 0.040 inch diameter, and tube 1502 is a silicone tube with inner and outer diameters of 0.058 and 0.076 inches, respectively. This structure allows flow through tube 1502 when the pressure in the tube is 3.3 psi above atmospheric pressure on one side of the structure and is atmospheric pressure on the other side. The example in FIG. 15*h* is similar to the example in FIG. 15*g* except that in FIG. 15*h* elastic member 1528 has a slit 1529 that allows it to be placed around tube 1502 without the need to thread tube 1502 through a hole in member 1528.

The invention claimed is:

1. A pump comprising:

a) a flexible tube, wherein said pump is configured to provide an output constriction of said flexible tube, wherein said output constriction is at a fixed output location on said flexible tube during operation of said pump;

b) a pump body;

c) a pump member, wherein said pump member is moveable relative to said pump body;

wherein said pump member is capable of moving to at least a refill position, a seal position, and an expel position, all relative to said pump body;

wherein said pump member and pump body at said seal position and at said expel position form an input constriction of said flexible tube at a fixed input location, wherein said input constriction impedes flow through said flexible tube more than said output constriction;

wherein part or all of said flexible tube between said input constriction and said output constriction defines a pump chamber having a pump chamber volume;

wherein said pump member and pump body at said expel position cause said pump chamber volume to be substantially less than said pump chamber volume when said pump member and pump body are at said seal position; and wherein said pump member and pump body at said refill position allow flow through said flexible tube past said fixed input location.

2. The pump of claim 1, wherein said flexible tube is elastic.

3. The pump of claim 1, wherein an outer surface of said flexible tube is coated with a material that limits diffusion of gas through a wall of said flexible tube during operation of said pump.

4. The pump of claim 1, wherein an elastic mechanism tends to hold said pump chamber open.

5. The pump of claim 1, wherein said pump body and said pump member have a nominal relative position provided by an elastic mechanism.

6. The pump of claim 5 in which said nominal relative position is said refill position or said expel position.

7. The pump of claim 1, wherein said pump member is elastic and movement of said pump member between said seal position and said expel position entails elastic deformation of said pump member.

8. The pump of claim 1, wherein said pump member is capable of being driven to said refill, seal and expel positions in a repeating sequence.

9. The pump of claim 1, wherein said pump member and said pump body are shaped such that said pump chamber volume is substantially the same when said pump member is at said refill and seal positions.

10. The pump of claim 1, wherein an outer surface of said flexible tube is lubricated at locations where said outer surface contacts said pump body or said pump member.

11. The pump of claim 1, wherein said pump member and pump body are attached to said flexible tube so that when said pump member is at said refill position, force is exerted on said flexible tube tending to cause its lumen to open.

12. A bidirectional pump comprising:

a first pump as in claim 1; and a second pump as in claim 1;

wherein said first and second pumps share said flexible tube and share said output constriction; and wherein said shared output constriction is disposed between said input constriction of said first pump and said input constriction of said second pump.

13. The pump of claim 1, wherein said flexible tube passes through a slot disposed near said input constriction, wherein said input constriction is between said slot and said output constriction, wherein said slot compresses said tube without blocking flow in said tube, and wherein compression of said tube provided by said slot causes the lumen of said tube to tend to open at said fixed location of said input constriction when said pump member is at said refill position.

14. The pump of claim 1, further comprising an input constriction adapter, wherein said input constriction adapter comprises a first mechanism capable of constricting a first side of said tube, and a second mechanism capable of constricting a second side of said tube opposite said first side;

wherein forces exerted by said first and second mechanisms on said flexible tube remain substantially constant during operation of said pump.

15. The pump of claim 14, wherein forces exerted by said first and second mechanisms of said input constriction adapter on said flexible tube are sufficient to at least partially collapse walls of said flexible tube, whereby formation of said input constriction by motion of said pump member is facilitated.

16. The pump of claim 1, wherein an effectiveness of said output constriction in blocking flow of material in said flexible tube is mechanically adjustable.

17. The pump of claim 1, wherein said flexible tube passes through said pump such that said flexible tube bends and kinks near said output constriction to form at least part of said output constriction.

18. The pump of claim 1, wherein said output constriction comprises a structure selected from the group consisting of: two rigid or semi-rigid members on opposite sides of said tube and an elastomeric substance disposed between said rigid or semi-rigid members and said tube; two rigid or semi-rigid members on opposite sides of said tube; a rigid or semi-rigid member on one side of said tube and a rod on the opposite side of said tube and elastically anchored to said rigid or semi-rigid member; a clip on said tube; a clip which compresses the edges of said tube with first and second sub-clips and compresses the middle of said tube with a third sub-clip; an elastic member disposed partially or completely around said flexible tube so as to compress said flexible tube; and an elastomeric tube around said flexible tube and between two rigid or semi-rigid members.

19. The pump of claim 1, wherein said output constriction comprises a first mechanism capable of constricting a first side of said tube, a second mechanism capable of constricting a second side of said tube opposite said first side, and a third mechanism capable of constricting part of said tube between said first and second sides.

20. The pump of claim 19, wherein a force exerted by said third mechanism on said flexible tube is less than a force exerted by either said first mechanism or said second mechanism on said flexible tube.

21. The pump of claim 1, wherein said pump member comprises a major lever and a minor lever mechanically coupled to said major lever;

wherein at said seal position of said pump member, one end of said minor lever is in contact with said flexible tube at said input constriction, thereby creating a support for said minor lever about which said minor lever rotates as said pump member moves from said seal position to said expel position.

22. The pump of claim 21 wherein said major and minor levers tend to return to a nominal position relative to each other due to an elastic mechanism.

23. The pump of claim 21 wherein said major and minor levers are contiguous parts of said pump member.

24. The pump of claim 21 wherein said minor lever is in slidable contact with said major lever.

25. The pump of claim 24 wherein said minor lever has a first curved surface that fits a complementary second curved surface of said major lever.

26. The pump of claim 1, wherein sensors placed on or near said pump member, said pump body, or said tube provide feedback on the position of said pump member or said tube to a control circuit.

27. The pump of claim 1, further comprising a driving circuit that causes said pump member to move to said seal, expel and refill positions in succession, in response to one or more pulses that initiate pump member motion from said refill position.

28. The pump of claim 1, further comprising a single actuator capable of driving said pump member to any of said refill, seal and expel positions.

29. The pump of claim 28, wherein said actuator comprises a motor with a cam in contact with one of said pump member and said pump body.

30. The pump of claim 28, wherein said actuator comprises shape memory alloy (SMA) wire.

31. The pump of claim 1 further comprising:

an elastic member disposed at or near said output constriction;

wherein said pump member and said pump body make contact at said elastic member and then snap past said elastic member as said pump member moves from said seal position to said expel position; and wherein said pump member and said pump body make contact at said elastic member and then snap past said elastic member as said pump member moves from said expel position to said refill position.

32. The pump of claim 1, further comprising:

an input mechanism disposed at or near said input location to prevent motion of said flexible tube relative to said pump body; and an output mechanism disposed at or near said output constriction to prevent motion of said flexible tube relative to said pump body.

33. A method of pumping a deformable material, the method comprising:

providing a pump as in claim 1;

admitting a deformable material into said flexible tube;

repeatedly moving said pump member from said refill position to said seal position, and then from said seal position to said expel position, and then from said expel position to said refill position;

whereby said deformable material is pumped through said flexible tube past said output constriction.

34. The method of claim 33, wherein said input constriction opens substantially after said pump chamber expands as said pump member moves from said expel position to said refill position.

35. The method of claim 33, wherein said input constriction opens substantially before said pump chamber expands as said pump member moves from said expel position to said refill position.

* * * * *